US006667433B1

(12) United States Patent
Qian et al.

(10) Patent No.: US 6,667,433 B1
(45) Date of Patent: Dec. 23, 2003

(54) FREQUENCY AND PHASE INTERPOLATION IN SINUSOIDAL MODEL-BASED MUSIC AND SPEECH SYNTHESIS

(75) Inventors: Xiaoshu Qian, Cupertino, CA (US); Yinong Ding, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 823 days.

(21) Appl. No.: 08/989,701

(22) Filed: Dec. 12, 1997

Related U.S. Application Data

(60) Provisional application No. 60/032,969, filed on Dec. 13, 1996.

(51) Int. Cl.[7] ..... G10H 5/02

(52) U.S. Cl. ..... 84/659; 84/622; 84/623

(58) Field of Search ..... 84/607, 622–625, 84/659–661, 621; 364/723, 724.1

(56) References Cited

U.S. PATENT DOCUMENTS 5,559,298 A * 9/1996 Okamoto ..... 84/607
5,665,928 A * 9/1997 Wang ..... 84/621

* cited by examiner

*Primary Examiner*—Marlon T. Fletcher
(74) *Attorney, Agent, or Firm*—Warren L. Franz; Wade James Brady, III; Frederick J. Telecky, Jr.

(57) ABSTRACT

A quadratic phase interpolation method for synthesis of musical tones incorporates both phase and frequency measurements at the boundaries of a data frame using a weighted least square algorithm approach. The approach assumes that the true frequency and phase at the two ends of a data frame conform to a quadratic phase model and that exact match between measured phase and frequency with the quadratic model is not necessary because of the noise in the measurements.

7 Claims, 1 Drawing Sheet

FREQUENCY AND PHASE INTERPOLATION IN SINUSOIDAL MODEL-BASED MUSIC AND SPEECH SYNTHESIS

This application claims priority under 35 U.S.C. §119(e) (1) of provisional application Ser. No. 60/032,969 filed Dec. 13, 1996.

This invention relates generally to music and speech synthesis and, in particular, to sinusoidal model-based synthesis.

BACKGROUND OF THE INVENTION

In 1986, McAulay and Quatieri of Lincoln Laboratory, MIT, proposed to represent speech/music signals as a sum of sinusoids parameterized by time-varying amplitudes, frequencies and phases. See, R. J. McAuley & T. F. Quatieri, "Speech Analysis/Synthesis Based On A Sinusoidal Representation," *IEEE Transactions on Acoustics, Speech, and Signal Processing*, vol. 34, pp. 744–754, August 1986. Their Sinusoidal Transformation System (STS) based on this model greatly impacted the research and development of sinusoidal modeling-based music analysis/synthesis. Serra and Smith of Stanford University extended the sinusoidal model to include a stochastic part in their Spectral Modeling System (SMS). See, X. Serra, *A System For Sound Analysis/Transformation/Synthesis Based On A Deterministic Plus Stochastic Decomposition*, Ph.D. Thesis, Stanford University, Stanford, Calif., 1989. The extension provides a mechanism to model the audible characteristics and identity resulted from complicated turbulence in some sounds.

In both STS and SMS, the analysis and synthesis are performed on a frame-by-frame basis. In analysis, an average amplitude, frequency and phase for each sinusoid are obtained by measuring the magnitude, frequency and phase positions of each peak in the Fourier transform of the data frame. In synthesis, these parameters are interpolated to generate individual sine waves, and these sine waves are mixed to yield the sinusoidal part of the synthesized sound.

Generating those individual sine waves in a real-time music synthesizer imposes a major demand on the computation power. For example, a modern professional music synthesizer typically requires simultaneous generation of at least 32 notes. Each note contains about 40 sinusoids on average. Thus a total of $32\times40\approx1{,}200$ sinusoids need to be generated in real-time at the sampling rate of at least 44.1 kHz. This requirement, when combined with other system overhead, make the implementation difficult even with present high speed digital signal processors (DSPs).

Reducing this computation requirement in synthesis is a first motivation for the present invention. In McAulay & Quatieri, above, the amplitude (in dB) and the phase track within a data frame are modeled by linear and cubic polynomials respectively. Clearly, the computational requirement for generating phase samples can be reduced by using quadratic phase polynomials in place of cubic ones. However, previous efforts in reducing the phase polynomial order have not been very successful. The main reason is that the phase and frequency, a total of four measurements at the two ends of a data frame, cannot in general be made in exact agreement with a quadratic polynomial, which has only three free parameters. The usual practice is to neglect phase measurements in favor of frequency measurements, but this seems to cause significant degradation in the fidelity of the synthesized sound. See, McAulay & Quatieri, above.

SUMMARY OF THE INVENTION

About 90% of the computational cost of an analysis-based music synthesis system using the oscillator bank approach is spent on generating the sinusoidal samples. Computation of the phase samples of the sinusoids takes about one-half of that cost (assuming sinusoidal values are pre-stored).

The invention provides a quadratic phase model approach to music and speech analysis and synthesis, wherein the polynomial coefficients are determined by least-square fitting the model using both frequency and phase measurements. Unlike methods using existing quadratic algorithms, which ignore either phase or frequency measurements at the boundaries of the data frame, the proposed quadratic phase interpolation algorithm method incorporates both measurements using a weighted least square frame algorithm. The underlying assumption is that the true frequency and phase at the two ends of a data frame conform to a quadratic phase model and the exact match between measured phase and frequency with the quadratic model is not necessary because of the noise in the measurements.

An advantage of the inventive approach is that the resulting frequency tracks for musical tones tend to be smoother (i.e. with less spurious oscillations) than the ones generated from the cubic algorithm. It can be shown (see below) that when the frequency does not vary much over a data frame, which is a typical case in a musical tone, the cubic-interpolated frequency track will always have slopes with opposite signs at the two ends of each data frame. This tends to cause oscillation in the interpolated frequency track as illustrated by the solid line in FIG. 1. Although the oscillation is typically small and hardly noticeable when the frequency track is plotted in usual scale, it is deemed undesirable for synthesizing musical tones.

Another advantage of the proposed approach is that it can be used to save storage requirements and reduce the computation complexity of the system. After the least square fitting is completed, the fitted frequency samples can be stored at the frame boundaries in place of the measured ones. Then the fitted phase track can be obtained simply by integration of the instantaneous frequency, which is taken to be the linear interpolation of the fitted frequency samples at the frame boundaries. This eliminates the need to store the phase samples at the frame boundaries and simplifies the computation needed to determine the polynomial coefficients. Compared with the commonly used cubic phase interpolation algorithm, the proposed algorithm eliminates one-third of the computational operations and reduces the parameter storage by 50%.

Informal listening tests on about two dozen musical notes analyzed reveal no performance degradation from the cubic phase interpolation algorithm to the proposed quadratic algorithm.

DETAILED DESCRIPTION OF PREFERRED EMBODIMENTS

Figure 1:
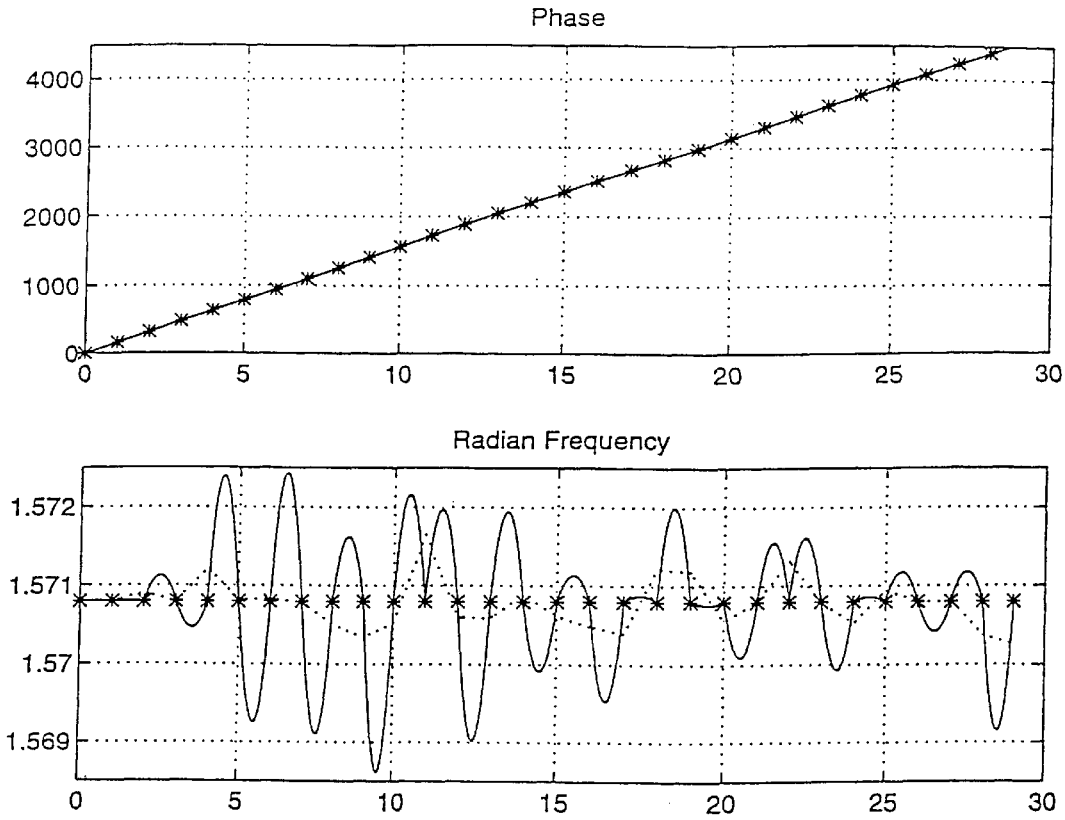
FIG. 1 shows interpolated frequency tracks obtained from McAulay and Quatieri's cubic spline algorithm (solid line) and from the proposed quadratic algorithm (dotted line) for a special case when frequency measurements (asterisks) at the frame boundaries are constant and phase contains 1% random perturbations.

McAulay and Quatieri, above, model the phase function within each data frame as a cubic polynomial. Thus the phase and frequency in a (say ith, $0\leqq i<N$) data frame can be written as:

$$\theta_i(\tau)=a_i+b_i\tau+c_i\tau^2+d_i\tau^3,\ \omega_i(\tau)=b_i+2c_i\tau+3d_i\tau^2, \quad (1)$$

where $\tau=t-t_i$. The polynomial coefficients are determined from the estimated phase and frequency ($\theta_i$, $\theta_{i+1}$, $\omega_i$, $\omega_{i+1}$) at the frame boundaries $$\theta_i(0)=\theta_i,$$
$$\omega_i(0)=\omega_i,$$
$$\theta_i(T)=\theta_{i+1}+2\pi M,$$
$$\theta'_i(T)=\omega_{i+1}, \tag{2}$$

where M is an integer which unwraps the measured phase. They determine this integer by assuming effectively that the average frequency across the data frame can be approximated by $(\omega_i+\omega_{i+1})/2$ or the phase increment across the data frame is approximately $(\omega_i+\omega_{i+1})T/2$. Thus, $$M = \frac{1}{2\pi}\left[\theta_i + \frac{\omega_i+\omega_{i+1}}{2}T - \theta_{i-1} + \varepsilon\right], \tag{3}$$

where $\epsilon$ is the smallest number that makes M an integer. Clearly $|\epsilon|<\pi$. The conditions in Equation (2) yield $$a_i = \theta_i, \tag{4}$$
$$b_i = \omega_i,$$
$$c_i = \frac{\omega_1-\omega_0}{2T} + \frac{3\varepsilon}{T^2},$$
$$d_i = -\frac{2\varepsilon}{T^3}.$$

McAulay and Quatieri's interpolation algorithm (hereafter abbreviated as MQ algorithm or cubic algorithm) seems to gain wide acceptance along with the large success of their sinusoidal representation based speech analysis/synthesis paradigm. However, in a recent attempt to apply this scheme to analysis of notes from a variety of musical instruments, it was noted that the interpolated frequency track tends to exhibit small oscillations which are especially conspicuous when the frequency change across a frame is small. This is illustrated in FIG. 1. In this case, the frequency measurements at the frame boundaries ($t=t_i$) were assumed to be a constant ($\omega_0$) while the measured, wrapped phases were generated by the relation $\theta_i=(1+0.01e_i)(\omega_0 t_i \bmod 2\pi)$, where perturbation $e_i$'s are used to model the phase measurement errors and are simulated by random numbers from a normal distribution with zero mean and unit variance. The interpolated frequency track (solid line in FIG. 1) is then generated using the MQ algorithm. The oscillation in the frequency track is actually predictable from the interpolation formula (Equation (1)). Using the coefficients in Equation (2), the frequency derivatives at the frame boundaries can be expressed as:

$$\dot{\omega}_i(0) = \frac{\omega_{i+1}-\omega_i}{T} + \frac{6\varepsilon}{T^2},\ \dot{\omega}_i(T) = \frac{\omega_{i+1}-\omega_i}{T} + \frac{6\varepsilon}{T^2}.$$

Note the second term in $\omega_i(0n)$ is always equal in magnitude but opposite in sign to the second term in $\omega_i(T)$. Thus when no significant frequency change occurs across the frame (i.e., the first term is small), the frequency derivatives at the adjacent two frame boundaries will also be of opposite signs, forcing the frequency track within each frame to have a (either right-side up or upside-down) bowl shape. In general, these "side lobes" will always ride on top of the average frequency slope $(\omega_{i+1}-\omega_i)/T$ (unless $\epsilon=0$, in which case the phase is quadratic). But when the frequency slope is large, one normally would not see those small ripples on top of the large frequency variation due to diminished relative contribution of the second terms.

Use of Quadratic Phase Computation Algorithm

Motivated by reducing the computation cost and producing smoother frequency tracks, experimentation was performed with the quadratic phase model $$\theta_i(\tau)=a_i+b_i\tau+c_i\tau^2,\ \omega_i(\tau)=b_i+2c_i\tau, \tag{5}$$

where $\tau=t-t_i$ as before. Assuming there are N frames $[t_i, t_{i+1}]$, i=0, . . . , N−1, then there will be 3N unknowns. These are determined as follows. A first requirement is that the unwrapped phase and frequency be continuous at the frame boundaries $t_i$, i=1, . . . , N−1. This gives a set of 2(N−1) conditions:

$$\theta_i(T)=\theta_{i+1}(0),\omega_i(T)=\omega_{i+1}(0)i=0,\ldots,N-2$$

where T is the frame length. Those 2(N−1) continuity conditions can be used to reduce the number of unknowns in the problem to 3N−2(N−1)=N+2. The remaining unknowns (call them $\alpha_k$, $-2\leqq k<N$) are then determined by minimizing the following square error $$E = \lambda\sum_{i=0}^{N}(\theta(t_i)-\theta_i)^2 + (1-\lambda)T^2\sum_{i=0}^{N}(\omega(t_i)-\omega_i)^2. \tag{6}$$

Note same phase unwrapping method as in MQ algorithm is used here to unwrap the phase measurements and for brevity, $\theta_i$ is used here to denote the unwrapped phase. Setting all partial derivatives of E with respect to $\alpha_k$ to zeros, N+2 equations are obtained which can be arranged compactly in a matrix form $$A\alpha=\lambda(\Theta_0+\Theta_1)+2(1-\lambda)T(\Omega_0-\Omega_1), \tag{7}$$

where A is an N+2 by N+2 symmetric tridiagonal matrix with the main diagonal [a/2, a, . . . , a, a/2] and the first diagonal [b, . . . , b] with $$a = \lambda + 4(1-\lambda)$$
$$b = \frac{\lambda}{2} - 2(1-\lambda).$$

The other variables in Equation (7) are given by $$\alpha=[\alpha_{-2},\alpha_{-1},\ldots,\alpha_{N-1}]',$$
$$\Theta_0=[0,\theta_0,\ldots,\theta_N]',$$
$$\Theta_1=[\theta_0,\ldots,\theta_N,0]',$$
$$\Omega_0=[0,\omega_0,\ldots,\omega_N]',$$
$$\Omega_1=[\omega_0,\ldots,\omega_N,0]'.$$

Equation (7) can be used to solve for $\alpha_k$. Then the polynomial coefficients in Equation (5) can be expressed as $$a_i = \frac{1}{2}(\alpha_{i-1}+\alpha_{i-2}), \tag{8}$$

$$b_i = \frac{1}{T}(\alpha_{i-1}-\alpha_{i-2}), \tag{9}$$

-continued $$c_i = \frac{1}{2T^2}(\alpha_i - 2\alpha_{i-1} + \alpha_{i-2}) \tag{10}$$

Note for $\lambda=4/5$, the matrix A in Equation (7) becomes diagonal. In this case, the polynomial coefficients can be expressed directly in terms of phase and frequency estimates at the frame boundaries $$\begin{aligned} a_i &= \frac{1}{4}(\theta_{i+1} + 2\theta_i + \theta_{i-1}) - \frac{T}{8}(\omega_{i+1} - \omega_{i-1}), \\ b_i &= \frac{1}{2T}(\theta_{i+1} - \theta_{i-1}) - \frac{1}{4}(\omega_{i+1} - 2\omega_i + \omega_{i-1}), \\ c_i &= \\ &\frac{1}{4T^2}(\theta_{n-2} - \theta_{i+1} - \theta_i + \theta_{i-1}) - \frac{1}{8T}(-\omega_{n+2} + 3\omega_{i+1} - 3\omega_i + \omega_{i-1}). \end{aligned} \tag{11}$$

for n=1, . . . , N−1 (except $c_{N-1}$), and $$\begin{aligned} a_0 &= \frac{1}{4}(3\theta_0 + \theta_1) - \frac{T}{8}(\omega_0 + \omega_1), \\ b_0 &= \frac{1}{2T}(\theta_1 - \theta_0) + \frac{1}{4}(3\omega_0 - \omega_1), \\ c_0 &= \frac{1}{4T^2}(\theta_2 + \theta_1) + \frac{1}{8T}(-\omega_2 + 3\omega_1 - 4\omega_0), \\ c_{N-1} &= \frac{1}{4T^2}(-\theta_{N-1} + \theta_{N-2}) + \frac{1}{8T}(4\omega_N - 3\omega_{N-1} + \omega_{N-2}). \end{aligned} \tag{12}$$

Except for this special case, there seems no obvious way of solving Equation (7) frame-by-frame in real time. There are two alternatives to get around this problem in real-time synthesis. First, since a quadratic model is used, the polynomial coefficients are uniquely determined by the initial phase ($\theta_i(0)$) and the frequency values ($\omega_i(0)$ and $\omega_i(T)$) at the frame boundaries. Thus one can choose to store the fitted frequency samples (i.e. $b_i$) at the frame boundaries and obtain the fitted phase track simply by integration of the instantaneous frequency that is linearly interpolated from the fitted frequency samples at the frame boundaries:

$$\theta_i(\tau) = \theta_{i-1}(T) + b_i\tau + \frac{b_{i+1} - b_i}{2T}\tau^2.$$

This eliminates the need to store the phase samples (except maybe the initial phase in the first frame). Alternatively, one can store both phase ($a_i$) and frequency ($b_i$) at the frame boundaries and compute the third coefficient by $c_i=(b_{i+1}-b_i)/2T$. This might be necessary when the phase track is long and the accumulation of the round-off errors resulting from using the phase value at the end of a frame as the initial phase of the following frame prevents the first method from being used. Both methods, however, simplify the computation needed to determine the polynomial coefficients compared with the cubic algorithm.

It might be interesting to look at the least square algorithm associated with Equation (6) under some special cases. It turns out that the equation associated with the last row of matrix A in Equation (7) is redundant when $\lambda=0$ or 1 and an extra condition is needed to completely specify all the polynomial coefficients. In the case of $\lambda=0$, the method ignores the phase measurements and is equivalent to linearly interpolating the frequency and integrating the frequency to get the phase. Thus the extra condition can be given by setting the initial phase $\alpha_0$ in the first frame to a desired (say, measured) value. When $\lambda=1$, the method ignores the frequency measurements and is equivalent to a quadratic spline algorithm that determines the splines from phase measurements and frequency continuity conditions at the frame boundaries. In this case, the extra condition is usually given by specifying the frequency derivative ($2c_0$) in the first frame. The simplest way is to set $c_0=0$, thus making the frequency constant in the first frame. Although the exact fit is achieved for both of these two choices of $\lambda$, they are not very attractive because they either ignore the phase or the frequency measurements. Except for these two special cases, the exact fit can only be achieved when the phase and frequency measurements at the frame boundaries conform exactly to a quadratic phase model. Of course, in this latter scenario, the exact fit will be achieved for any choice of $\lambda$.

For the implementation, it is noted that each sample on a quadratic phase track can be computed using two addition operations with the following recursion:

$$\theta_i(0)=\theta_{i-1}(T),$$

$$\Delta_i[0]=b_ih+c_ih^2,$$

$$\theta_i((n+1)h)=\theta_i(nh)+\Delta_i[n],$$

$$\Delta_i[n+1]=\Delta_i[n]+(2h^2c_i).$$

where n is an integer such that $0<nh<T$ and h is the sampling interval. By adding one more level of recursion, this scheme can be easily extended to evaluating a cubic phase sample with three addition operations.

Some preliminary tests of the algorithm were performed. The test results presented were obtained with $\lambda=4/5$ for computation simplicity. FIG. 1 shows the frequency track (dotted line) resulting from the inventive approach algorithm for the special case shown there. It can be seen in this case that although the fitted frequencies deviate from the measured ones at the frame boundary, the overall track is closer to the true one and is smoother than the track obtained from the MQ algorithm.

Finally, mention is made of one other algorithm for determining the coefficients of cubic phase polynomials. An attempt was made to use only the frequency measurements plus the continuity condition of the phase and derivative of the frequency at the frame boundaries. In other words, the phase measurements at the frame boundaries in the MQ algorithm were replaced with the continuity constraint of the frequency derivatives. The hope was that the frequency track would become smoother and the algorithm simpler. However, the resulting sound quality produced from this scheme was found to be poorer than the proposed least square quadratic algorithm (even if $\lambda=0$) or the MQ algorithm. Inspection of the interpolated frequency tracks obtained from this method revealed large oscillation in the tracks.

The foregoing presents a method for analysis of notes from musical instruments that uses a least square quadratic phase interpolation algorithm. The algorithm uses two addition operations to generate each sample in the phase tracks. Compared with McAulay and Quatieri's cubic phase interpolation algorithm, the proposed method algorithm eliminates one of the three additions required for generating each phase sample in the original algorithm and requires only one-half of the stored parameters in real-time synthesis. It also produces smoother frequency tracks (i.e. with less spurious oscillations).

Experiments with methods of determining parameters in either the cubic or quadratic phase model suggest that ignoring phase measurements usually leads to degradation of the quality of the synthesized musical sound.

What is claimed is:

1. A method for synthesizing music and/or speech sound signals using sinusoidal modeling, comprising the steps of:

measuring frequency and phase values at frame boundries $t=t_i$ and $t=t_{i+1}$ ($0 \leqq i \leqq N$) for N data frames of interval length T of a sampled signal;

modeling phase and frequency functions for the ith data frame using a quadratic phase model $\theta_i(\tau)=a_i+b_i\tau+c_i\tau^2$, $\omega_i(\tau)=b_i+2c_i\tau$, where $\tau=t-t_i$;

determining polynomial coefficients $a_i$, $b_i$, $C_i$ assuming unwrapped phase and frequency are continuous at frame boundries, and determining unknowns by minimizing a square error function; and synthesizing said music and/or speech sound signals fron said model and coefficients.

2. The method of claim 1, wherein N+2 coefficient unknowns $\alpha_k$ ($-2 \leqq k < N$) are determined by minimizing the square error function $$E = \lambda \sum_{i=0}^{N} (\theta(t_i) - \theta_i)^2 + (1-\lambda)T^2 \sum_{i=0}^{N} (\omega(t_i) - \omega_1)^2;$$

with estimated phase and frequency ($\theta_i$, $\Theta_{i-1}$, $\omega_i$, $\omega_{i+1}$) at the frame boundaries being determined by $$\theta_i(0)=\theta_i,$$

$$\omega_i(0)=\omega_i,$$

$$\theta_i(T)=\theta_{i+1}+2\pi M,$$

and $$\theta'_i(T)=\omega_{i+1},$$

where M is an integer which unwraps the phase.

3. The method of claim 1, wherein the coefficients are determined by $$a_i = \frac{1}{2}(\alpha_{i-1} + \alpha_{i-2}),$$

$$b_i = \frac{1}{T}(\alpha_{i-1} - \alpha_{i-2}), \text{ and}$$

$$c_i = \frac{1}{2T^2}(\alpha_i - 2\alpha_{i-1} + \alpha_{i-2}).$$

4. The method of claim 1, further comprising the steps of generating individual sine waves from the determined parameters; and mixing the sine waves to yield the sinusoidal part of the synthesized sound signal.

5. The method of claim 1, further comprising the steps of:

storing fitted frequency samples $b_1$ determined for the frame boundaries; and obtaining the fitted phase functions by integrating instantaneous frequency, taken as a linear interpolation of the fitted frequency samples stored for the frame boundaries $$\theta_i(\tau) = \theta_{i-1}(T) + b_i\tau + \frac{b_{i+1} - b_i}{2T}\tau^2.$$

6. The method of claim 1, further comprising the steps of:

storing fitted phase samples $a_i$ determined for the frame boundaries; and computing the coefficients $c_i$ by $$c_i=(b_{i+1}-b_i)/2T.$$

7. A method for synthesizing music and speech sound signals using sinusoidal modeling, comprising the steps of:

measuring frequency and phase values at frame boundries $t=t_i$ and $t=t_{i+1}$ ($0 \leqq i < N$) of N data frames of interval length T of a sampled signal;

modeling phase and frequency functions for each ith data frame using a quadratic phase model $\theta_i(\tau)=a_i+b_i\tau+c_i\tau^2$, $\omega_i(\tau)=b_i+2c_i\tau$, where $\tau=t-t_i$;

determining polynomial coefficients $a_i$, $b_i$, $C_i$ directly in terms of phase and frequency at frame boundries at frame boundries as follows:

$$a_i=(1/4)(\theta_{i+1}+2\theta_i+\theta_{i-1})-(T/8)(\omega_{i+1}-\omega_{i-1}),$$

$$b_i=(1/2T)(\theta_{i+1}-\theta_{i-1})-(1/1/4)(\omega_{i+1}-2\omega_i+\omega_{i-1}),$$

$$c_i=(1/4T^2)(\theta_{n+2}-\theta_{i+1}-\theta_i+\theta_{i-1})-(1/8T)(-\omega_{n+2}+3\omega_{i+1}-3\omega_i+\omega_{i-1});$$

for n=1, . . . , N−1 (except $C_{N-1}$); and $$a_0=(1/4)(3\theta_0+\theta_1)-(T1/8)(\omega_{i+1}-\omega_{i-1}),$$

$$b_0=(1/2T)(\theta_1-\theta_0)+(1/4)(3\omega_0-\omega_1),$$

$$c_0=(1/4T^2)(\theta_2-\theta_1)+(1/8T)(-\omega_2+3\omega_1-4\omega_0),$$

$$c_{N-1}=(1/4T^2)(-\theta_{N-1}+\theta_{N-2})+(1/8T)(4\omega_N-3\omega_{N-1}+\omega_{N-2};$$

and synthesizing said music and/or speech sound signals from said model and coefficients.

* * * * *